US006623092B2

(12) United States Patent
Kim et al.

(10) Patent No.: US 6,623,092 B2
(45) Date of Patent: Sep. 23, 2003

(54) INK CARTRIDGE WITH SEPARATE MAGNETS

(75) Inventors: Jeong-seon Kim, Suwon-si (KR); Oh-hyun Baek, Seoul (KR); Jae-cheol Lee, Suwon-si (KR); Sik-sun Choi, Suwon-si (KR); Jong-suk Seo, Suwon-si (KR); Young-su Lee, Suwon-si (KR); Moo-youl Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/108,362

(22) Filed: Mar. 29, 2002

(65) Prior Publication Data

US 2003/0030682 A1 Feb. 13, 2003

(30) Foreign Application Priority Data

Aug. 13, 2001 (KR) ..... 2001-48737

(51) Int. Cl.[7] ..... B41J 2/195

(52) U.S. Cl. ..... 347/7

(58) Field of Search ..... 347/7, 6, 20, 5, 347/1, 68, 95, 48, 98, 85, 84, 86, 87; 73/861; 346/139 R

(56) References Cited

U.S. PATENT DOCUMENTS 5,583,544 A 12/1996 Stamer et al. ..... 347/7
6,502,933 B2 * 1/2003 Lim et al.

OTHER PUBLICATIONS

U.S. patent application Ser. No. 09/761,841 by Lim et al., filed on Jan. 18, 2001.
Korean Patent Application No. 2000–65519 by Lim et al., filed in Republic of Korea on Nov. 6, 2000, together with an English language translation and a certificate of the translation (The Korean Patent Application No. 2000–65519 filed in the Republic of Korea on Nov. 6, 2000 corresponds to the U.S. patent application Ser. No. 09/761,841 filed on Jan. 18, 2001).

* cited by examiner

*Primary Examiner*—Raquel Yvette Gordon
(74) *Attorney, Agent, or Firm*—Robert E. Bushnell, Esq.

(57) ABSTRACT

An ink cartridge using separate magnets is provided. The ink cartridge includes an ink container, which includes first and second chambers separated by a vertical partition formed therewithin for containing ink, and a head for ejecting the ink in the ink container onto a printing medium in the form of droplets. The first chamber includes a sponge filling most of the inside of the first chamber, a filter provided on a bottom portion of the sponge, and an ink supply pipe for supplying the ink which has passed through the filter to the head. The second chamber includes a magnet float floating on the ink in the second chamber and including a first magnet in its inside, and a second magnet provided in the bottom surface of the second chamber. The ink cartridge includes a magnet sensor for detecting a magnetic flux having at least a predetermined level when the magnet float contacts the second magnet. Accordingly, the ink cartridge with separate magnets does not require a cartridge container to be formed of a transparent material. By using the separate magnets, a magnetic flux having a strength necessary for detection can be induced while preventing magnetic interference between ink containers provided for different colors.

16 Claims, 4 Drawing Sheets

INK CARTRIDGE WITH SEPARATE MAGNETS

CLAIM OF PRIORITY

This application makes reference to, incorporates the same herein, and claims all benefits accruing under 35 U.S.C. §119 from my application INK CARTRIDGE WITH SEPARATE MAGNETS filed with the Korean Industrial Property Office on Aug. 13, 2001 and there duly assigned Ser. No. 48737/2001.

BACKGROUND OF THE INVENTION

1. Field of the Invention

The present invention relates to an ink cartridge with separate magnets, and more particularly, to an ink cartridge for detecting a state of ink consumption using two separate upper and lower magnets in an ink chamber by detecting a magnetic flux having a predetermined level when the two magnets are combined.

2. Description of the Related Art

Ink cartridges used for ink jet printers contain ink and eject ink droplets through a head, so that an image of a predetermined color can be printed on a printing medium. FIG. 1 is a sectional view of an ink cartridge with two chambers, which is disclosed in U.S. Pat. No. 6,012,808. Referring to FIG. 1, an ink cartridge 1 includes two chambers, i.e., an ink containing chamber 10 and a sponge chamber 20, separated by an internal vertical partition 30. The sponge chamber 20 is filled with a sponge 24, and the ink containing chamber 10 supplies ink to the sponge chamber 20 through a clearance 32 formed in a lower portion of the vertical partition 30. An ink supply outlet 22 through which ink is supplied to an ink jet printer head (not shown) is formed at one side of the sponge chamber 20. An air vent 26 is formed at the top of the sponge chamber 20. A light reflecting plate 12 is provided at a lower portion of the vertical partition 30 in the ink containing chamber 10. A light emitting element 13 for radiating light onto the light reflecting plate 12 and a light receiving element 14 for detecting light reflected from the light reflecting plate 12 are provided outside the ink containing chamber 10 to face the light reflecting plate 12.

In the ink cartridge 1, when ink in the sponge 24 is exhausted, ink is absorbed into the sponge 24 by the capillary attraction of the sponge 24 and is thus supplied to the sponge chamber 20. Here, the air flowing into the sponge chamber 20 through the air vent 26 helps ink in the ink containing chamber 10 to be supplied to the sponge chamber 20. When the ink level in the ink containing chamber 10 is below the light reflecting plate 12 as ink is consumed, light emitted from the light emitting element 13 is reflected from the light reflecting plate 12. When the reflected light is detected by the light receiving element 14, it is recognized that there is almost no ink left in the ink cartridge 1.

However, when the ink cartridge 1 having the above structure is installed in the printer head, bubbles may be introduced into the head, thereby degrading printing quality. Accordingly, suction is applied to remove bubbles, which wastes ink. In addition, use of an optical sensor such as the light emitting element 13 or the light receiving element 14 may result in erroneous sensing due to, for example, scattered reflection in residual ink. Moreover, a cartridge container 2 is required to have good light transmissivity so that light can be transmitted through the cartridge container 2.

SUMMARY OF THE INVENTION

It is therefore an object of the present invention to provide an improved ink cartridge having an improved apparatus for detecting when the ink cartridge runs out of ink.

It is another object of the present invention to embody the magnets and the magnet sensor in each chamber of a multicolored printhead where the magnets in one chamber do not influence the magnets in an adjacent chamber.

These and other objects of this invention can be achieved by a structure where there is provided an ink cartridge including an ink container, which includes first and second chambers II partially separated by a vertical partition formed therewithin for containing ink, and a head for ejecting the ink from the first chamber filled with an ink-soaked sponge onto a printing medium in the form of droplets. Near the head, the first chamber includes a filter located at a bottom portion of the sponge, and an ink supply pipe for supplying the ink which has passed through the filter to the head. The second chamber includes a magnet float floating on the surface of the ink in the second chamber and having a first magnet embedded inside, and a second magnet provided in the bottom surface of the second chamber. The ink cartridge includes a flexible printed circuit board disposed around the head of the ink container to control the head, The ink cartridge also includes a magnet sensor near the second magnet and outside the ink container for detecting magnetic flux caused by the first magnet contacting the second magnet triggering a signal to a user when the magnetic flux experienced by the sensor reaches or exceeds a predetermined threshold level. Preferably, the magnet float is made of a foam-molded polypropylene resin, and the first magnet is a plastic magnet. Also, preferably, the magnet sensor is a Hall effect sensor which outputs a detection signal when a magnetic flux of at least a predetermined level is detected.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
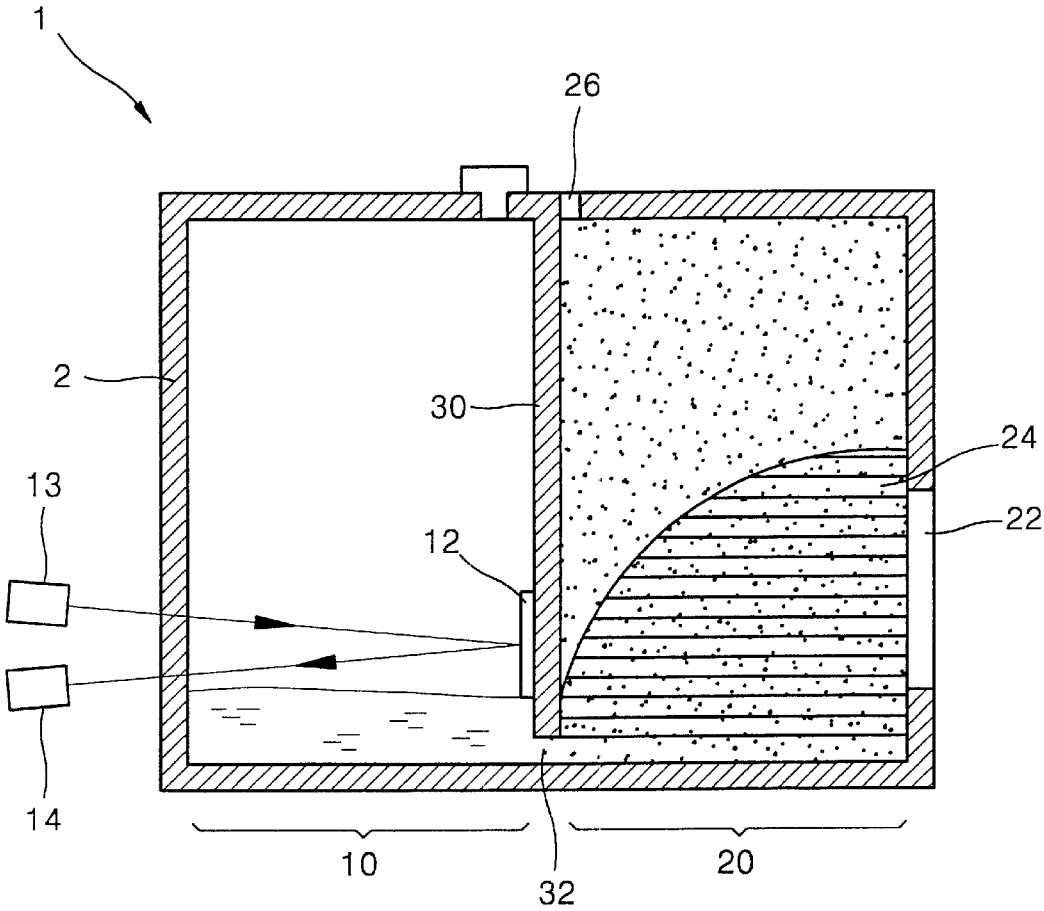
FIG. 1 (PRIOR ART)
FIG. 1 is a sectional view of a prior art ink cartridge with two chambers using light transmission, reflection and detection to determine when the amount of ink remaining in an ink chamber is too low.
Figure 2:
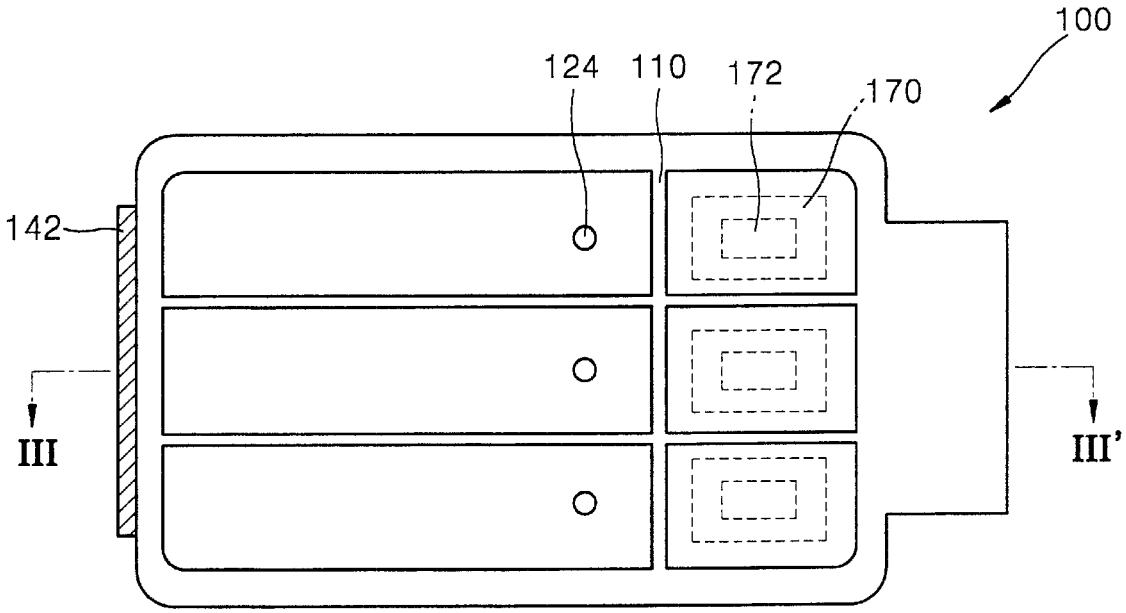
FIG. 2 is a plan view of an ink cartridge with separate magnets according to a preferred embodiment of the present invention.
Figure 3:
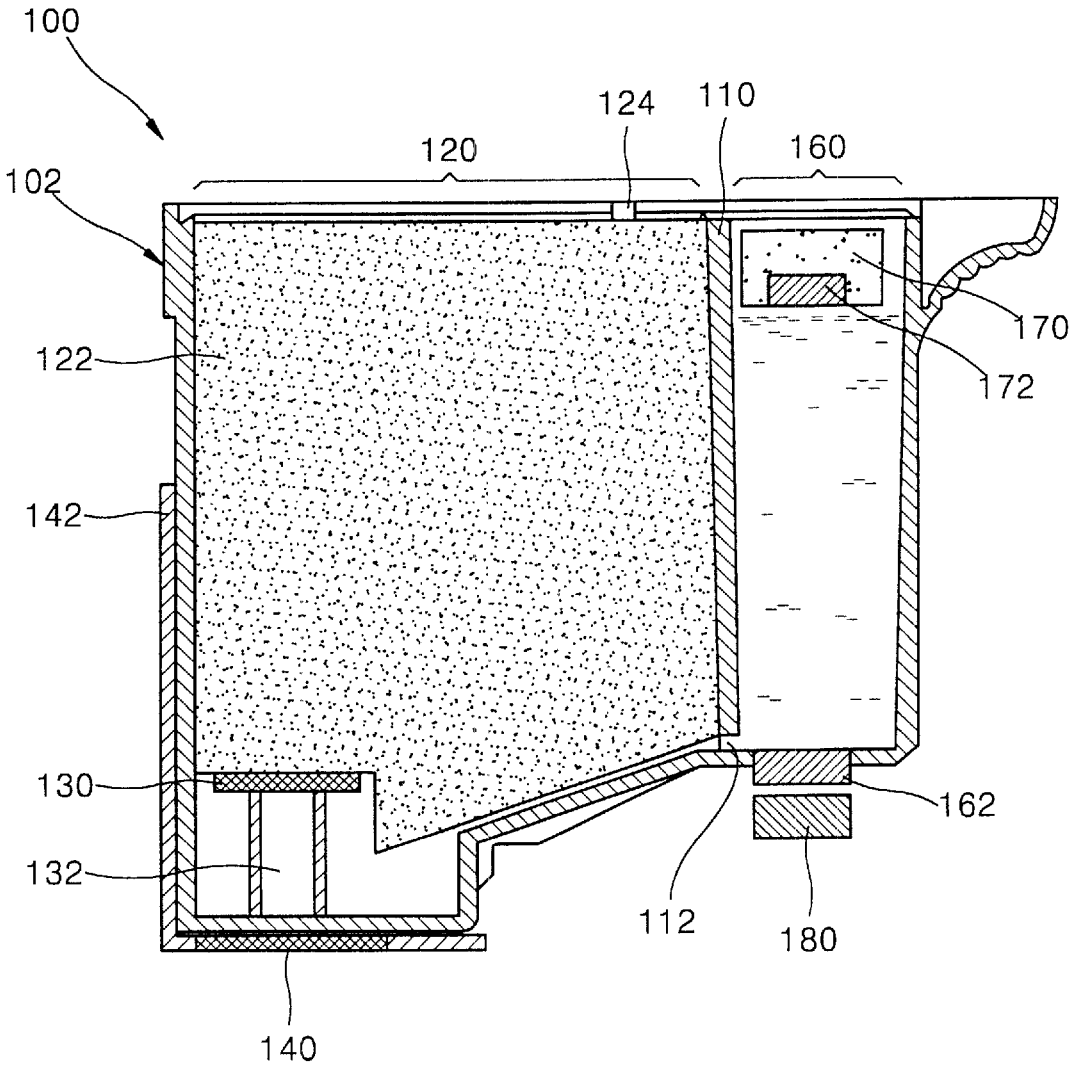
FIG. 3 is a sectional view of the ink cartridge of FIG. 2, taken along the line III–III'.

FIG. 2 is a plan view of an ink cartridge 100 with separate magnets according to a preferred embodiment of the present invention. FIG. 3 is a sectional view of the ink cartridge of FIG. 2, taken along the line III–III'. FIGS. 2 and 3 show the color ink cartridge 100 containing three types of ink, i.e., yellow ink, magenta ink, and cyan ink, in three ink containers 102 having the same structure as shown in FIG. 3.

Referring to FIGS. 2 and 3, the ink cartridge 100 includes an ink container 102 for containing ink and a head 140 for ejecting ink in the form of droplets. The ink container 102 is separated into two first and second chambers 120 and 160 by a partition 110 which vertically extends from the top of the inside of the ink container 102 toward the bottom thereof. A clearance 112 is provided below the partition 110.

The first chamber 120 is almost filled with a sponge 122. A filter 130 is provided below a portion of the sponge 122 in contact with the sponge 122 to exclude impurities and fine bubbles from ink, thereby preventing a nozzle of the head 140 from being clogged. An ink supply pipe 132, through which an ink is supplied to the head 140, is provided below the filter 130. A flexible printed circuit (FPC) 142 is disposed around the head 140 to control the head 140. An air vent 124 is formed at the top of the first chamber to prevent excessive negative pressure caused when ink is drained from the sponge 122. The sponge 122 is made of polyurethane foam.

The second chamber 160 includes a magnet float 170 floating on ink within the second chamber 160 and a second magnet 162 fixed to the bottom of the second chamber 160. The magnet float 170 is made of foam-molded polypropylene resin and includes a first magnet 172 in its bottom surface. The first magnet 172 is a plastic magnet.

The first magnet 172 must be designed to prevent interference between the first magnet 172 and another first magnet 172 provided in a neighboring second chamber 160 for containing ink of a different color from stopping the magnet 172 from going down when the level of ink in the second chamber 160 goes down. In addition, when the first magnet 172 reaches the bottom of the second chamber 160, the first magnet 172 must be sensed by a magnet sensor 180, which is installed below the second chamber 160 and separated from the second chamber 160 by a predetermined distance. Accordingly, in the present invention, the magnetic flux which can be sensed by the magnet sensor 180 is divided between the first magnet 172 and the second magnet 162 to avoid the described interference. That is, instead of reducing the magnetic flux of the first magnet, the second magnet 162 is installed at the bottom of the second chamber 160, and the combined magnetic flux of these magnets 162 and 172 can be sensed by the magnet sensor 180.

In this embodiment of the present invention, a Hall effect sensor is used as the magnet sensor 180. And a selected Hall effect sensor can sense at least 500 gauss when separated from the bottom of the second magnet 162 by a distance of about 4 mm. The Hall effect sensor senses the South (S) pole of a magnet. Accordingly, the first and second magnets 172 and 162 are disposed to have the S pole at their bottoms. The magnetic flux of each of the first and second magnets 172 and 162 is chosen to be 300 gauss so that the combined magnetic flux of the magnets 172 and 162 is at least 500 gauss, which can be sensed by the selected Hall effect sensor. The above-mentioned strength of the magnetic flux is variable depending on the distance between the second magnet 162 and the magnet sensor 180, and the distance between the neighboring first magnets 172, etc.

Figure 4:
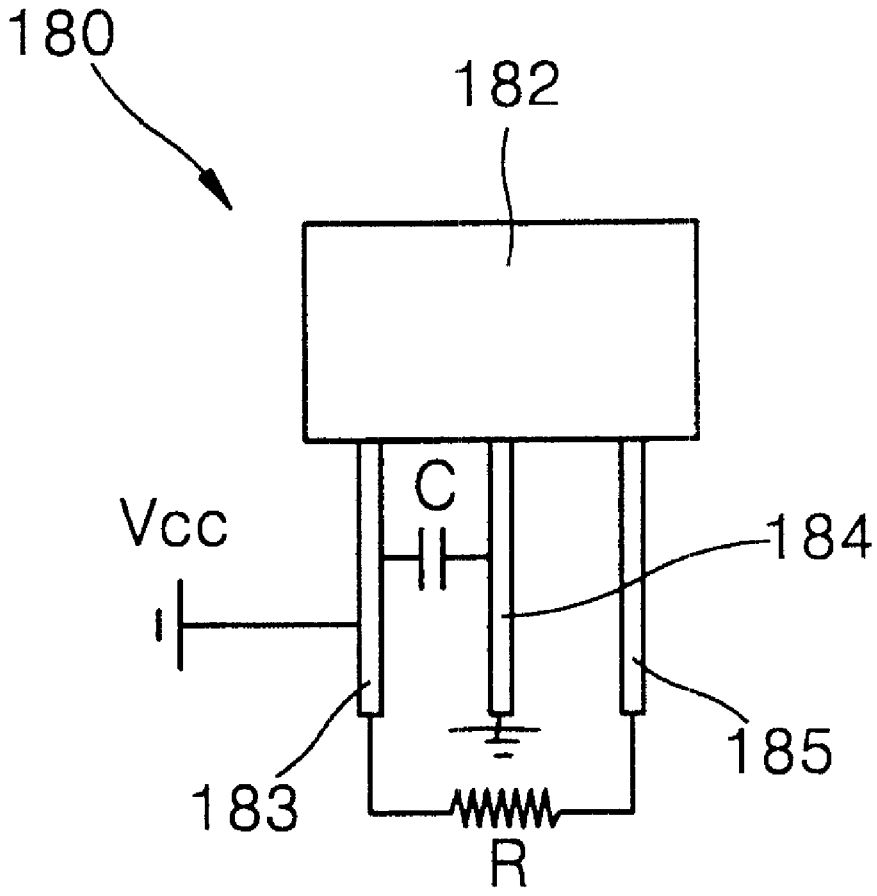
FIG. 4 is a diagram of an example of a Hall effect sensor according to the present invention.

FIG. 4 is a diagram of an example of the Hall effect sensor 180. Referring to FIG. 4, the Hall effect sensor 180 includes a sensing part 182 and three lead lines 183, 184, and 185. 3.3 V direct current voltage is applied to the first lead line 183. The second lead line 184 is grounded. The third lead line 185 is an output line. The sensing part 182 outputs a voltage of 3.3 V through the third lead line 185 when it detects a magnetic flux of at least a predetermined level, and outputs a voltage of 0 V through the third lead line 185 when it detects a magnetic flux of less than a predetermined level.

The operation of the ink cartridge 100 will be described in detail with reference to the drawings. In an initial state, the two first and second chambers 120 and 160 for each color in the ink cartridge 100 are fully filled with ink. During the use of a printer, the ink is supplied to the head 140 through the ink supply pipe 132, so the ink within the first chamber 120 is consumed, and the ink is drained from the sponge 122. While the ink is consumed, air flows into the first chamber 120 through the air vent 124, and the sponge 122 absorbs the ink from the second chamber 160 through the clearance 112 due to the capillary attraction of pores in the sponge 122. As the level of the ink in the second chamber 160 becomes lower, the magnet float 170 moves downward. Finally, the first magnet 172 makes contact with the second magnet 162, so a magnetic flux reaches around 600 gauss. And the sensing part 182 of the magnet sensor 180 operates to output a voltage of 3.3 V through the third lead line 185, thereby reporting that the level of ink in the ink cartridge is low.

During the above-described procedure, it is important to prevent each magnet float 170 from being hindered from moving together with the ink level due to magnetic force induced between the first magnets 172 in the respective color chambers 160.

As described above, an ink cartridge with separate magnets according to the present invention does not require a cartridge container to be formed of a transparent material. In addition, by using separate magnets, the present invention can induce a magnetic flux having a strength necessary for detection while preventing magnetic interference between ink containers provided for different colors.

While this invention has been particularly shown and described with reference to a preferred embodiment thereof, it will be understood by those skilled in the art that various changes in form and details may be made therein. Therefore, the true scope of the invention will be defined by the appended claims.

What is claimed is:

1. An ink cartridge, comprising:

an ink container, comprising:

a first chamber comprising a sponge soaked with ink and filling most of an inside of said first chamber; and a second chamber partially separated by a vertical partition formed between said first chamber and said second chamber, said second chamber comprising:

a magnet float floating on a surface of ink in said second chamber and having a first magnet stored inside said magnet float; and a stationary second magnet disposed at a bottom of said second chamber;

a head located at a bottom of said first chamber ejecting the ink in the ink container onto a printing medium in the form of droplets;

a flexible printed circuit disposed around the head to control the head;

an ink filter disposed between said head and said sponge removing particles before they reach said head;

an ink supply pipe disposed between said ink filter and said head; and a magnet sensor disposed exterior to said ink container near said second magnet detecting magnetic flux generated by contact of said first magnet with said second magnet when an ink level in said second chamber is low.

2. The ink cartridge of claim 1, the magnet float being made of a foam-molded polypropylene resin.

3. The ink cartridge of claim 1, the first magnet being a plastic magnet.

4. The ink cartridge of claim 1, the magnet sensor being a Hall effect sensor outputting a detection signal to a user when a magnetic flux of at least a predetermined level is detected.

5. The ink cartridge of claim 1, the sponge being made of polyurethane foam.

6. The ink cartridge of claim 1, said vertical partition extending from a top of said ink container to almost a bottom of said ink container, a gap being formed near said bottom of said ink container at a location where said vertical partition is absent allowing ink to freely flow from said second chamber to said first chamber to keep said sponge in said first chamber soaked with ink.

7. The ink cartridge of claim 1, said first chamber having an air vent disposed on a top surface of said first chamber of said ink container keeping an interior of said ink container at atmospheric pressure at all times while ink is being ejected from said head.

8. An ink cartridge ejecting a plurality of colors of ink, said ink cartridge having a plurality of ink containers disposed adjacent to each other, each ink container ejecting ink of a different color, each ink container having identical sensors to determine when a level of ink in each container runs low, each ink container comprising:

a first chamber comprising a sponge soaked with ink and filling most of an inside of said first chamber; and a second chamber partially separated by a vertical partition formed between said first chamber and said second chamber, said second chamber comprising:

a magnet float floating on a surface of ink in said second chamber and having a first magnet stored inside said magnet float; and a stationary second magnet disposed at a bottom of said second chamber;

a head located at a bottom of each first chamber ejecting ink in each ink container onto a printing medium in the form of droplets;

a flexible printed circuit disposed around said head to control said head; and a magnet sensor disposed exterior to each ink container near each second magnet detecting magnetic flux generated by contact of each first magnet with each corresponding second magnet when an ink level in each respective second chamber is low.

9. The ink cartridge of claim 8, each ink container having an ink filter disposed between each sponge and each head in said first chamber.

10. The ink cartridge of claim 9, each ink container having an ink supply pipe disposed between each filter and each head delivering filtered ink to each head for ejection.

11. The ink cartridge of claim 8, each magnet float being made of a foam-molded polypropylene resin.

12. The ink cartridge of claim 8, each first magnet being a plastic magnet.

13. The ink cartridge of claim 8, each magnet sensor being a Hall effect sensor outputting a detection signal to a user when a magnetic flux of approximately 600 gauss is detected.

14. The ink cartridge of claim 8, each sponge being made of polyurethane foam.

15. The ink cartridge of claim 8, each vertical partition extending from a top of each ink container to almost a bottom of each ink container, a gap being formed near said bottom of each ink container at a location where each vertical partition is absent, allowing ink to freely flow from each second chamber to said first chamber to keep each sponge in each first chamber soaked with ink.

16. The ink cartridge of claim 8, each first chamber having an air vent disposed on a top surface of each first chamber of each ink container keeping interiors of each ink container at atmospheric pressure at all times while ink is being ejected from each head.

* * * * *